US005928011A

United States Patent [19]

Flask et al.

[11] Patent Number: 5,928,011

[45] Date of Patent: Jul. 27, 1999

[54] SLIDE LOCK POSITION ASSURANCE AND RELEASE LEVER

[75] Inventors: William George Flask, Youngstown; Jay Harold Garretson, Warren, both of Ohio; Greg S. Reese, Troy, Mich.; John Henry Bakker, Cortland, Ohio

[73] Assignee: General Motors Corporation, Detroit, Mich.

[21] Appl. No.: 08/959,093

[22] Filed: Oct. 28, 1997

[51] Int. Cl.[6] ..... H01R 13/62

[52] U.S. Cl. ..... 439/157; 439/347

[58] Field of Search ..... 439/152, 157, 439/159, 160, 488, 489, 296, 299, 304, 310, 324, 344, 345, 346, 347, 350, 370, 266

[56] References Cited

U.S. PATENT DOCUMENTS 5,230,635 7/1993 Takenouchi et al. ..... 439/157
5,575,676 11/1996 Tsukakoshi et al. ..... 439/347
5,681,184 10/1997 Pamart et al. ..... 439/595
5,823,807 10/1998 Yamasaki et al. ..... 439/157
5,876,226 3/1999 Tsukakoshi et al. ..... 439/157

*Primary Examiner*—Hien Vu
*Assistant Examiner*—Ross Gushi
*Attorney, Agent, or Firm*—Cary W. Brooks; Patrick M. Griffin

[57] ABSTRACT

The present invention includes an electrical connector system utilizing a single piece slide lever system which is lockable in a pre-staged and in a final fully seated position. The slide lever is used to provide assurance of proper mating position of connector halves and to mechanically assist the mating of male and female connectors. The slide lever may also be received inside of a flexible grommet to provide a mechanical assist in making a seal between the grommet and a panel. The locking features and the slide lever may be selectively released to move the slide lever from a pre-staged position (open position) to a final seated position (closed position) locking the two connector pieces together. Likewise, the locking features on the slide lever may be released to move the slide lever from a final fully seated (closed) position back to a pre-staged (open) position to disconnect the connector pieces all while the slide lever is contained within the flexible grommet.

5 Claims, 6 Drawing Sheets

SLIDE LOCK POSITION ASSURANCE AND RELEASE LEVER

TECHNICAL FIELD

This invention relates to electrical connector systems utilizing a slide lever.

BACKGROUND OF THE INVENTION

The use of slide levers to mechanically assist the connection of mating connector pieces has been known. FIG. 6 illustrates such a known system including a first connector 210 having a body portion 212 with a plurality of metal terminals received therein and a surrounding housing 214. A slide lever is provided for slidable movement in a channel provided between the body portion and the outer housing. The slide lever includes a plunger portion 216 connected to a bridge 218 and two spaced apart parallel elongated lever arms 220. The lever arms 220 each include a slot formed therein generally in a diagonal direction with respect to the longitudinal axis of elongated lever arms. The system is shipped in an open pre-staged position utilizing a separate wedge piece 222 that is snapped onto the lever arms 220 and between the bridge 218 and the housing 214 or body portion 212 to prevent downward movement of the lever. The second mating connector housing (not shown) includes an outwardly extending pin that is received in the channel formed in the lever arms. For assembly of the two connector pieces, the second connector housing is placed in engagement with the housing 214 of the first connector and the wedge 222 is removed by an operator and the plunger 216 depressed causing the two connector pieces to be mated together as the pin rides along the diagonal slot of the lever arms 220. However, the separate wedge piece 222 can become dislodged during shipment causing the slide lever to be moved to a closed position. Further, the mating connector housing cannot be disconnected and the slide lever moved back to a pre-staged position without the use of the wedge piece 222 which may not be available in the field.

The present invention provides alternatives to and advantages over the prior art.

SUMMARY OF THE INVENTION

The present invention includes an electrical connector system utilizing a single piece slide lever system which is lockable in a pre-staged and in a final fully seated position. The slide lever is used to provide assurance of proper mating position of connector halves and to mechanically assist the mating of male and female connectors. The slide lever may also be received inside of a flexible grommet to provide a mechanical assist in making a seal between the grommet and a panel. The locking features and the slide lever may be selectively released to move the slide lever from a pre-staged position (open position) to a final seated position (closed position) locking the two connector pieces together. Likewise, the locking features on the slide lever may be released to move the slide lever from a final fully seated (closed) position back to a pre-staged (open) position to disconnect the connector pieces all while the slide lever is contained within the flexible grommet.

These and other objects, features and advantages of the present invention will become apparent from the following brief description of the drawings, detailed description and appended claims and drawings.

DESCRIPTION OF THE PREFERRED EMBODIMENT

Figure 1:
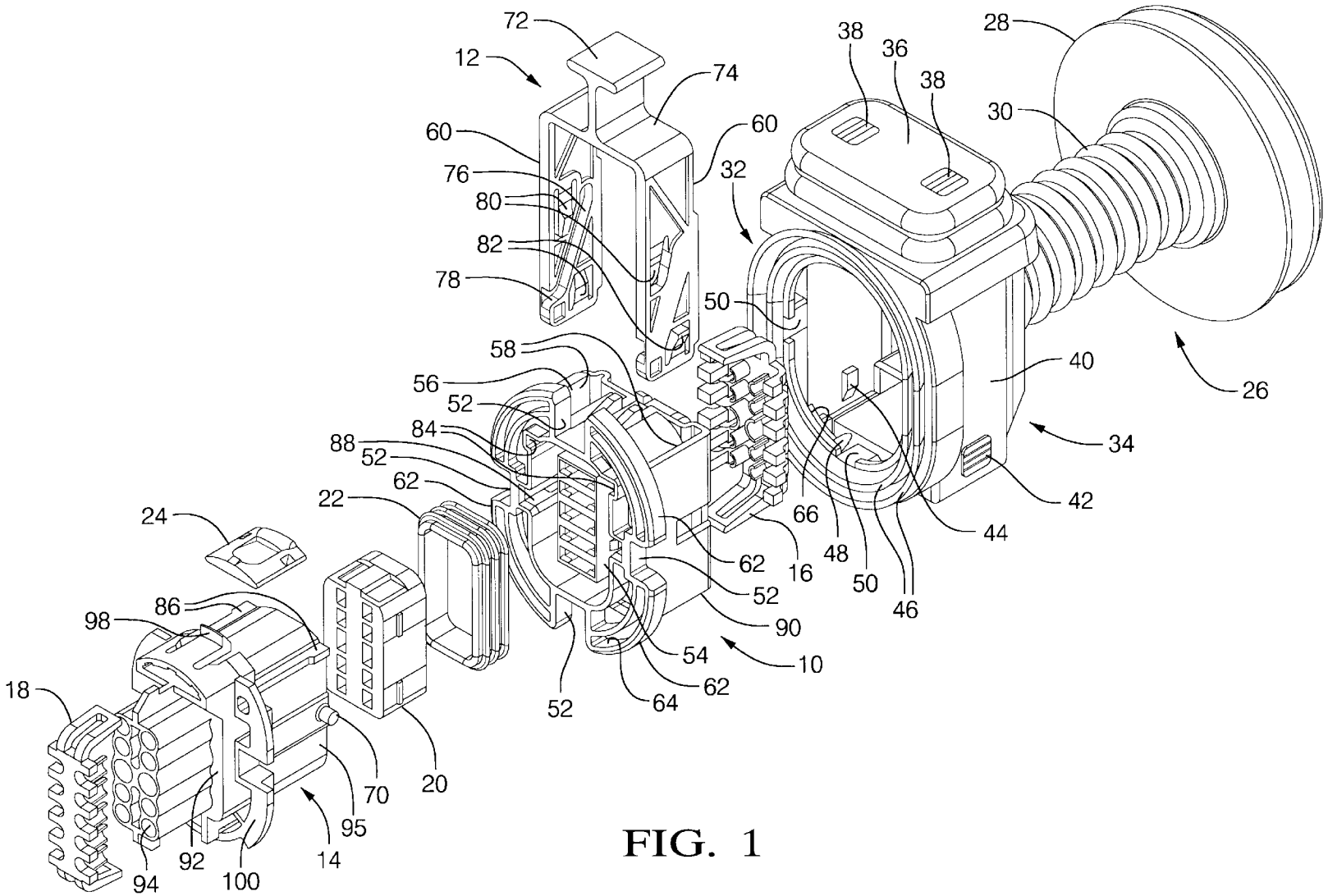
FIG. 1 is a perspective, exploded view of a connector system according to the present invention.

Referring to FIG. 1, a connector system according to the present invention may include a first connector component 10 such as a female connector housing and a slide lever 12 for slidable movement, with respect to the first connector component 10, from a first locked pre-staged (open) position to a second locked final seated (closed) position. A second connector component 14 is provided such as a male connector for mating with the first connector component 10 and the slide lever 12 so that the slide lever 12 may be used to mechanically assist the mating of the first connector component 10 to the second connector component 14. Optionally, additional components may be provided such as terminal position assurance members 16, 18 for the female connector and male connector 10, 14, respectively; a male terminal blade stabilizer 20 and associated seal 22 for insertion into the female connector 10; and a connector position assurance member 24 for connection to the connector component 14. A flexible grommet 26 may also be provided including a first sealing end 28 for attachment and sealing against a first panel (not shown) having an aperture therethrough through which a wire harness is extended. The grommet also includes a conduit portion 30 having a wire harness passage therethrough and a second sealing end 32 for sealing against a second panel. The second sealing end includes a housing 34 for receiving the first connector component 10 and the slide lever 12 in a manner which will be described hereafter.

The grommet housing 34 includes opposed upper and lower walls and opposed side walls. The upper wall having an outside surface 36 having two spaced apart sets of grip ribs 38 formed therein. The outside surface 40 of each of the side walls also includes a set of grip ribs 42 formed therein and an associated nub 44 formed on an inside face 46 of the side walls and aligned with the grip ribs 42. The second sealing end 32 has an opening 48 and two spaced apart annular sealing lips 46 surrounding the opening 48. The grommet housing 34 with the opening 48 is constructed and arranged so that a wire harness can be inserted through the grommet, and the first connector component 10 and slide lever 12 may be assembled together and inserted into the opening 48 and received inside of the grommet housing 34. Alignment features 50 may be formed on the inside faces of the walls forming the grommet housing 34 mateable with alignment features 52 on the first connector to prevent the first connector 10 from rotating inside of the grommet housing 34.

The slide lever 12 includes a plunger handle 72 connected to a bridge 74 and two downwardly extending elongated lever arms 60 extending from the bridge 74. Each elongated lever arms 60 includes a slot 76 running generally diagonally across the elongated lever arm and including an opening 78 at one end for receiving a lever pin 70 on the second connector component 14. Each lever arm 60 also includes an upper lock feature 80 which is preferably a flexible finger extending inwardly towards the center line of the slide lever. A lower lock feature 82 is provided on each lever arm 60 and preferably is a flexible finger extending outwardly from the center line of the slide lever.

The first connector part 10 may be of a female type including a body portion 54 for receiving a plurality of metal electrical terminals. A housing 56 may be connected to the body portion 54 to provide a channel 58 on each side of the body portion 54 for receiving one of the elongated lever arms 60 of the slide lever.

The first connector 10 may also include collar portions 62 having a recess 64 formed therein for receiving a ledge 66 formed in the inside face of the grommet to hold the female connector in position within the grommet. The first connector housing 56 may also include a channel 68 for receiving a pin 70 formed on an outer surface of the second connector component 14.

An inside surface of the first connector housing 56 has a first shoulder 84 formed therein for partially defining an indexing channel for receiving a ramped indexing projection 86 extending outwardly from the second connector 14. A second shoulder 88 is formed on the inside surface of the first connector housing below the first shoulder 84 to partially define a lever pin channel to receive a lever pin 70 extending outwardly from the second connector 14. The first connector housing 56 also includes a third shoulder 90 below the second shoulder 88.

The second connector component 14 is preferably a male connector having a body portion 92 having a plurality of recesses 94 formed therein for receiving a plurality of male terminals. A shroud 95 extends outwardly from the body portion to shield the blade portion of the male terminals received in the body portion 92. The lever pin 70 extends outwardly from the shroud 95 as does the ramped indexing projections 86. The male connector 14 may also include flexible lock fingers 98 for locking against a first surface of a panel 102 to be described hereafter and a collar 100 for engaging the other side of the surface of the panel 102 (shown in FIG. 5).

Figure 2:
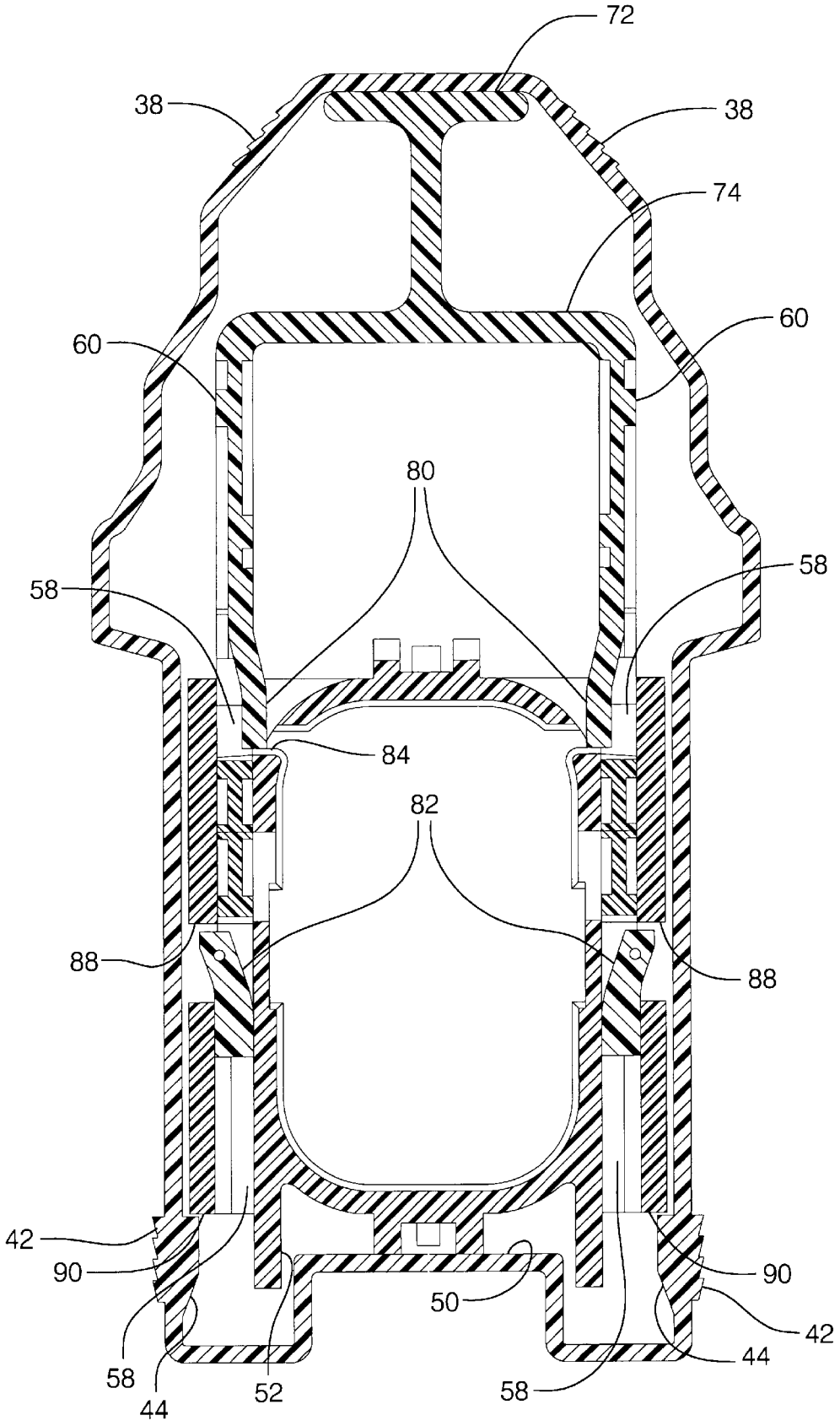
FIG. 2 is a sectional view of a connector system according to the present invention wherein the slide lever is received in the flexible grommet and connected to a first connector in a pre-staged (open) position.

Referring to FIG. 2, the elongated lever arms 60 of the slide lever 12 are inserted into the channels 58 formed in the first connector component 10 so that the slide lever is in a locked pre-staged (open) position. In this pre-staged position the upper lock features 80 engage the first shoulder 84 formed in the first connector housing to prevent downward movement of the lever arm and the lower lock features 82 are adjacent the second shoulder 88 formed in the first connector housing to prevent upward movement of the slide lever. These pre-staged locking features 80, 84 and 82, 88 thus act to secure the slide lever 12 against longitudinal movement in either direction and also to positively locate the open ends 78 of slots 76 in position to receive the lever pins 70 of the second connector component 14 when the components 10, 14 are joined. When the slide lever is in the pre-staged position, the slide lever 12 and the first connector component 10 are inserted into the flexible rubber grommet 26 as indicated earlier.

Figure 3:
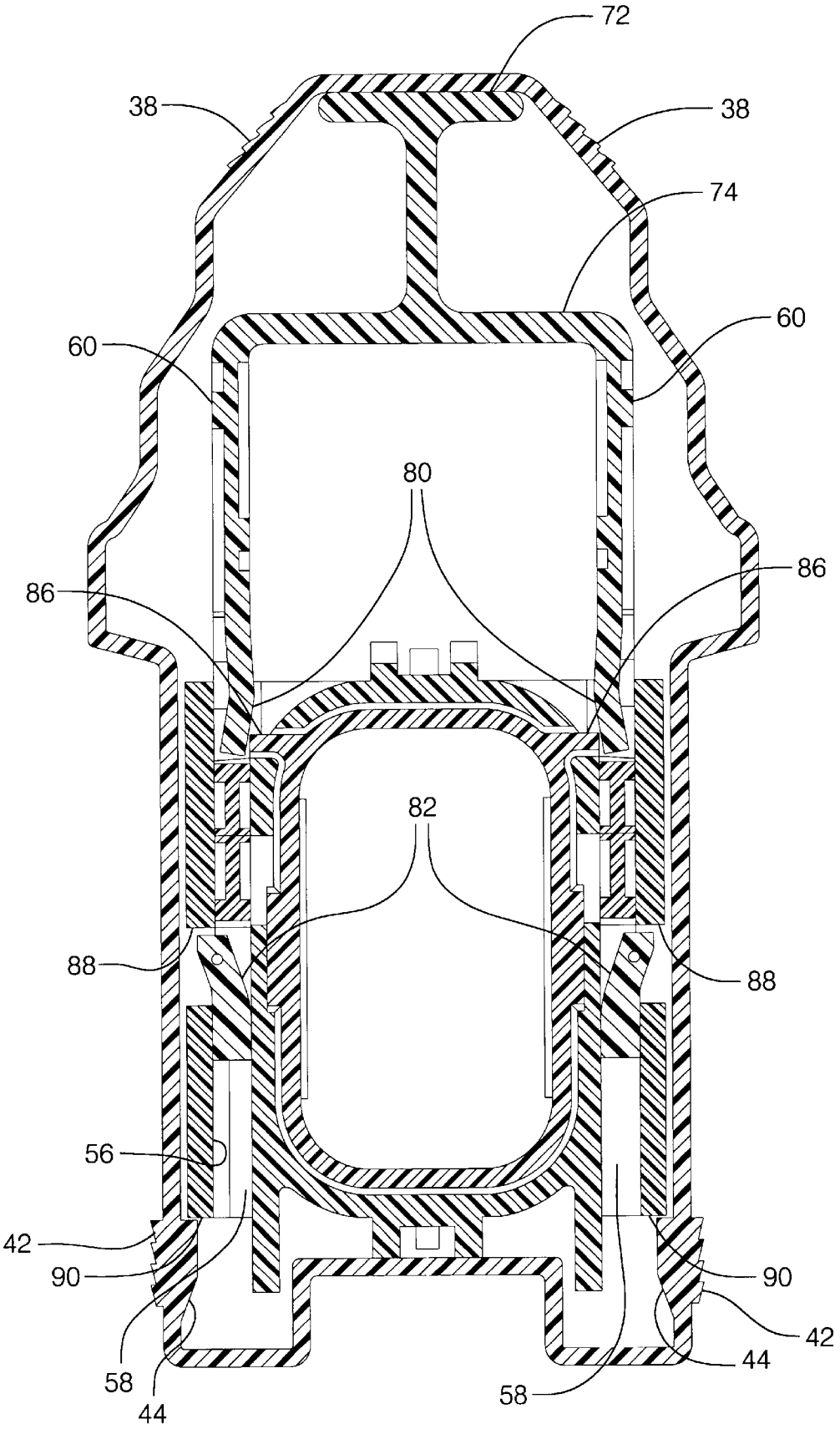
FIG. 3 is a sectional view of a connector system according to the present invention wherein the slide lever is received in the flexible grommet and a second connector has been inserted into a first connector deactivating one set of lock features on the slide lever.

Referring to FIGS. 1 and 3, while the first connector component 10 is received inside the grommet housing 34, the first connector component is moved towards the second connector component 14 so that the lever pin 70 is received in the lever pin channel defined partially by the second shoulder 88 and the indexing projection 86 is received in the indexing channel defined partially by the first shoulder 84. The first connector component 10 is moved further towards the second connector 14 so that the lever pin 70 is received in the open end 78 of the slot formed in the lever arms 60 of the slide lever 12 and so that the ramped indexing projections 86 force and deflect the upper lock feature 80 out of engagement with the first shoulder 84 to deactivate or unlock the upper lock feature 80.

With the upper lock feature 80 deactivated, the plunger 72 can be pushed downwardly so that the lower lock features 82 are biased inwardly by the inside surface of the housing 56 until the lower lock features 82 moves past and snap locks against the third shoulder 90 locking the connectors 10, 14 together and the lever arm 12 in a locked final seated (closed) position. These final seated locking features 82, 90 thus secure the lever arm 12 in the final seated position.

Figure 5:
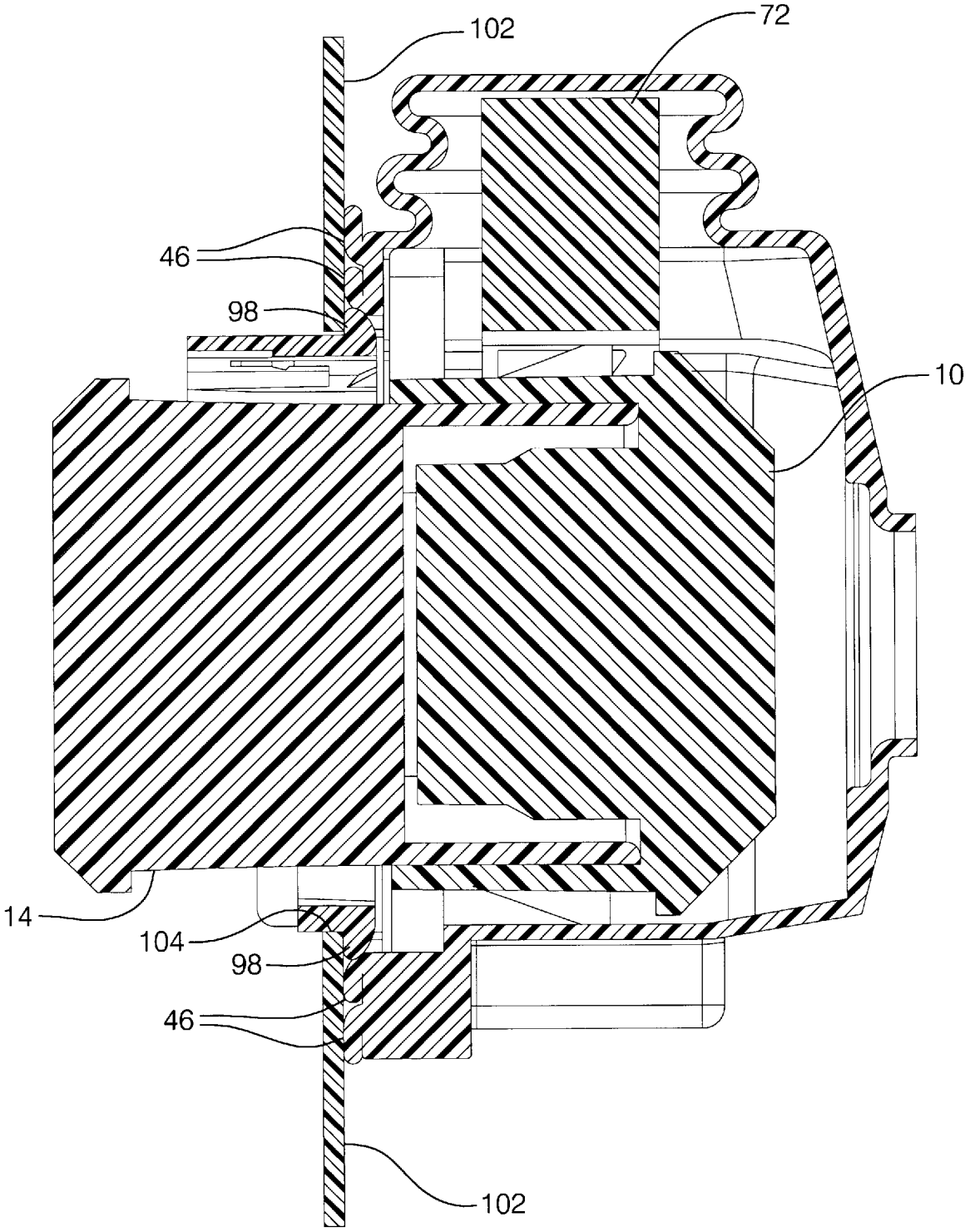
FIG. 5 is a sectional side view of a connector system according to the present invention showing the slide lever in a final seated (closed) position to make a water-tight seal between the grommet and a panel.
Figure 6:
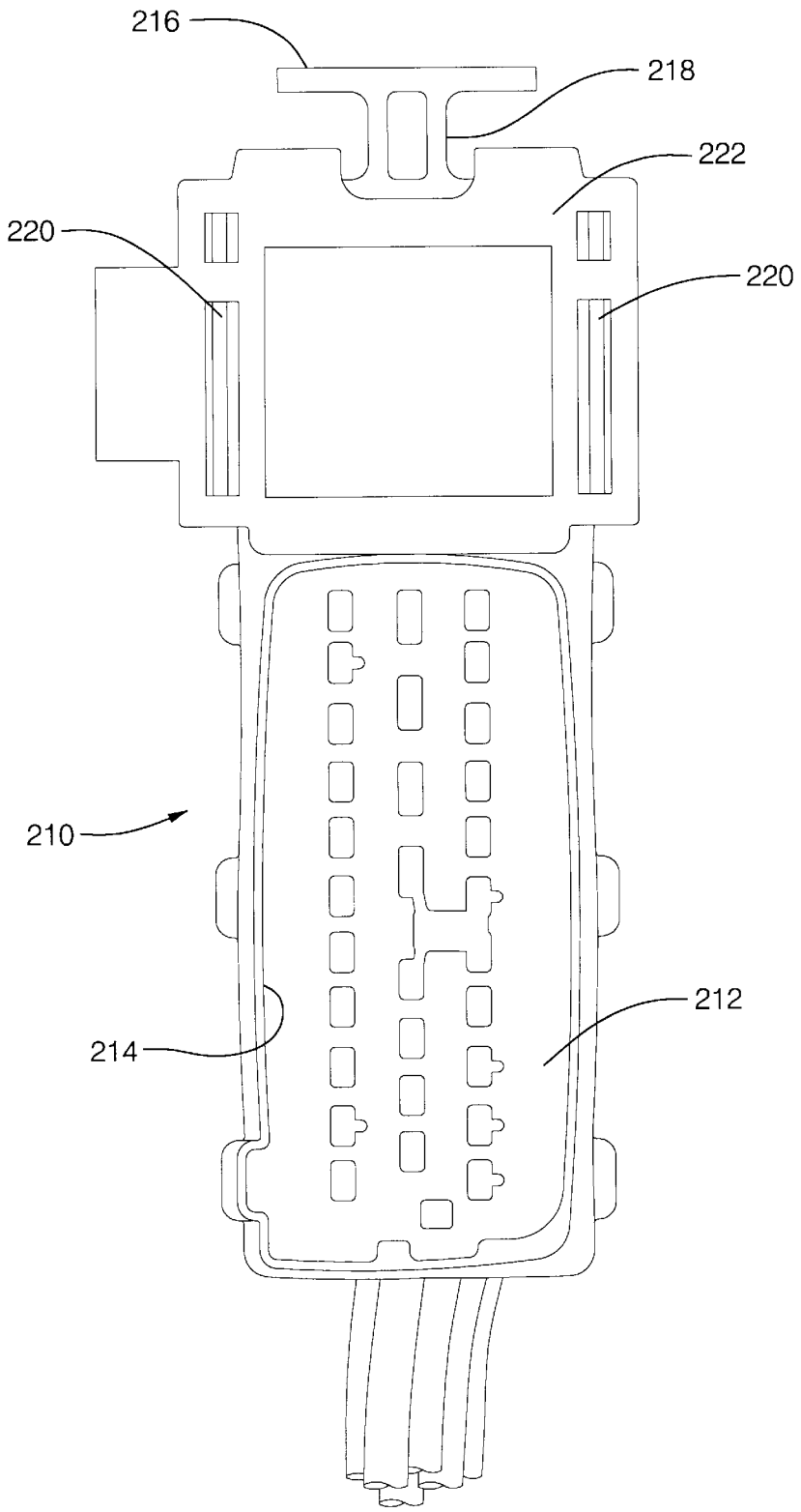
PRIOR ART FIG. 6
FIG. 6 is an illustration of a prior art two-piece slide lever connector system.

Referring to FIG. 5, as the slide lever 12 is moved downwardly to the final seated position, the slide lever not only locks the connectors 10, 14 together, but the slide lever mechanically assists in forming a good water-tight seal between the annular sealing lips 46 of the grommet and a panel 102 having an aperture 104 formed therein for receiving the second connector 14 by movement of the lever pins 70 along the length of the diagonal slots 76 to urge the components 10, 14 to fully mated relationship.

Figure 4:
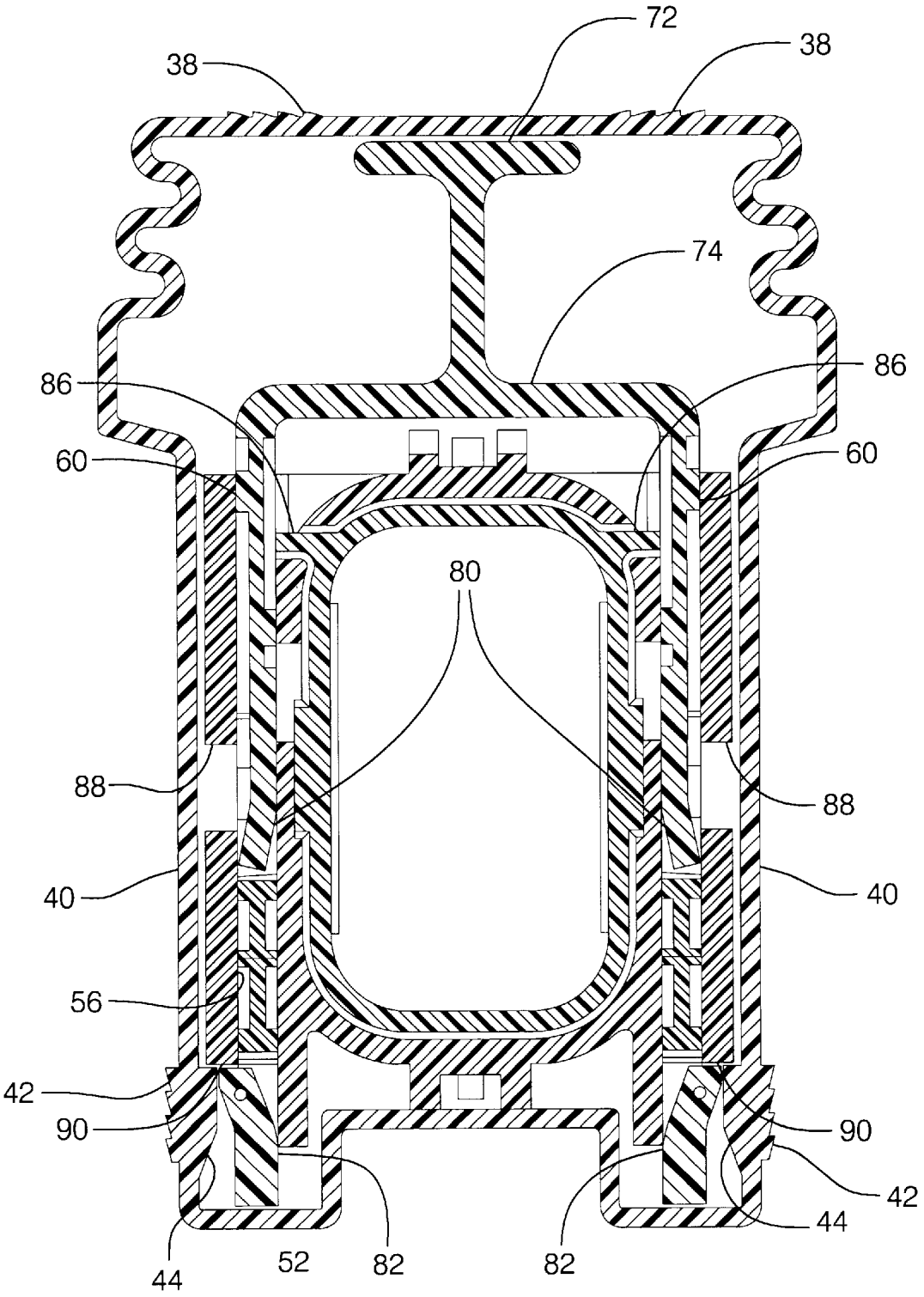
FIG. 4 is a sectional view of a connector system according to the present invention wherein the slide lever is in a final seated (closed) position.

Referring again to FIG. 4, to unlock the connectors 10, 14 and the slide lever 12 from its final seated position, a squeeze release is provided. An operator may press inwardly on the grommet along the side walls 40 near the grip ribs 42 causing the nub 44 on the inside surface (or wall) of the grommet to push the lower lock feature 82 inwardly out of engagement with the third shoulder 90 of the first electrical connector component so that the slide lever can be pulled upwardly by the plunger handle 72 until the slide lever 12 moves back into the pre-staged position shown in FIG. 2.

The connector system according to the present invention not only provides a mechanical assist for mating two connectors, but the slide lever also provides a mechanical assist for forming an improved water-tight seal of the grommet against a panel carrying one of the connectors. When a single piece slide lever is referred to in this application, the term single piece means a piece made from a continuous material that has not been pieced together from two parts such as by screwing, bolting, gluing, bonding or otherwise. For example, a single piece slide lever would be made from a single plastic mold operation resulting in a single piece part of continuous material.

We claim:

1. A connector system comprising:

first and second mateable electrical connector components and a single piece slide lever, said second connector component having a lever pin extending therefrom, said slide lever being constructed and arranged for slidable movement on said first electrical connector component to a locked pre-staged position and to a locked final seated position, said slide lever including at least a plunger arm and at least one elongated lever arm, said lever arm including a longitudinal axis and a slot formed therein running generally at an acute angle to said longitudinal axis of said lever arm and having an open end for receiving said lever pin into said slot when said slide lever is in said pre-staged position, said slide lever being secured slideably to said first electrical connector component, said slide lever and first connector component including pre-staged matable locking features engageable when said slide lever is moved to said pre-staged position to lock said slide lever in said pre-staged position against sliding movement in either longitudinal direction relative to said first connector component so as to secure said slide lever against removal from said first connector component and to positively locate said open end of said slot in position to receive said lever pin of said second connector component into said slot upon joining said first and second connector components with one another, said second connector component including unlocking features positioned to disengage said pre-staged matable locking features in response said joining of said connector components to enable movement of said slide lever from said pre-staged position to said final seated position whereupon said lever pin is caused to advance along a length of said slot urging said connector components toward a fully mated relationship, said slide lever and said first connector component further including final seated matable locking features positioned to engage when said slide lever is moved to said final seated position to thereby lock said slide lever in said final seated position.

2. The electrical connector system of claim 1 wherein said pre-staged matable locking features include first and second flexible lock fingers provided on said elongated lever arm constructed and arranged so that in said pre-staged position said first flexible lock finger engages a first shoulder on said first electrical connector and said second flexible finger engages a second shoulder on said first electrical connector to prevent said movement of said slide lever in said either longitudinal direction, and wherein said unlocking feature of said second connector comprises an element operative to deflect said first flexible finger out of engagement with said first shoulder allowing said slide lever to be moved to said final seated position.

3. The electrical connector system of claim 2 wherein said slide lever includes a bridge attached to said plunger arm and two spaced apart elongated lever arms extending from said bridge and wherein said first electrical connector includes a channel for slidable movement of each of said elongated lever arms.

4. The electrical connector system of claim 3 wherein said final seated locking features comprise a third shoulder on said first connector component positioned for engagement by said second flexible finger when moved to said fully seated position preventing said lever arm from being moved upward without unlocking said second flexible finger from said third shoulder.

5. The electrical connector system of claim 2 wherein said unlocking feature of said second connector component comprises a projection constructed and arranged to deflect and unlock the first flexible finger from engagement with said first shoulder when said slide lever is in said pre-staged position allowing an operator to depress said plunger arm to cause said first and second electrical connector components to be mated together.

* * * * *